US005702020A

United States Patent [19]

Larsen

[11] Patent Number: 5,702,020

[45] Date of Patent: Dec. 30, 1997

[54] DRINKING MUG

[76] Inventor: Randi Bollerup Larsen, Kirke Allé 5, Fousing, DK-7600 Struer, Denmark

[21] Appl. No.: 647,647

[22] Filed: May 15, 1996

Related U.S. Application Data

[63] Continuation of Ser. No. 367,153, filed as PCT/DK93/00238 Jul. 12, 1993, abandoned.

[30] Foreign Application Priority Data

Jul. 10, 1992 [DK] Denmark ..... 0905/92
Nov. 6, 1992 [DK] Denmark ..... 0790/93

[51] Int. Cl.[6] ..... A47G 19/22

[52] U.S. Cl. ..... 220/709; 220/710; 215/229

[58] Field of Search ..... 220/710, 709, 220/705, 707; 215/1 A, 229; 229/75

[56] References Cited

U.S. PATENT DOCUMENTS 2,914,214 11/1959 Messinger .
4,631,715 12/1986 Hoover .
4,775,060 10/1988 Pinney .
4,982,854 1/1991 Ichimiya ..... 220/710
5,005,717 4/1991 Oilar ..... 220/710
5,065,881 11/1991 Tarng ..... 220/710
5,078,286 1/1992 Hashimoto ..... 220/710

FOREIGN PATENT DOCUMENTS 2312220 12/1976 France .
2120218 11/1983 United Kingdom .

*Primary Examiner*—Joseph M. Moy
*Attorney, Agent, or Firm*—Watson Cole Stevens Davis, P.L.L.C.

[57] ABSTRACT

A drinking mug for small children, handicapped and hospital patients, comprising a cup, a lid and a suction tube, is configured in an airtight manner so that only access to the inside of the mug is through the suction tube. Tightness is achieved by disposing the suction tube on the inside of the lid on a drinking spout and by providing a sealing ring in the joint between the lid and the cup. Due to the airtight construction, when liquid is sucked up an under pressure is created inside the mug which subsequently empties the suction tube of liquid. Correspondingly, an attempt by the liquid to run out through the suction tube when the mug is tipped over is counteracted by the siphon effect which results from the airtight construction.

10 Claims, 4 Drawing Sheets

DRINKING MUG

CROSS-REFERENCE TO RELATED APPLICATION

This application is a continuation of application Ser. No. 08/367,153, filed as PCT/DK93/00238 Jul. 12, 1993, now abandoned.

BACKGROUND OF THE INVENTION

The invention relates to a drinking mug comprising a cup, a lid end at least one suction tube. Such drinking mugs, which are arranged to prevent spillage, are for example used for small children, the handicapped and hospital patients.

In addition to the mug being able to avoid the spillage of liquids, for example if it is tipped over, it is desirable for the mug to be of low weight, easy to use, easy to clean end able to be produced at low cost.

A mug of the kind described above is disclosed in U.S. Pat. No. 2,914,214, where the suction tube is secured to the lid, in that the mouth of the suction tube is found at the lid or over the lid outside the mug. On the lid there are two diametrically arranged mouthpieces each with a suction tube. The suction tubes extend right down towards the bottom, but are hereafter extended in an arc upwards towards the lid, in that the inlet to the suction tubes turns towards the lid or towards a space between two concentric walls in the cup. Although this mug is intended to prevent spillage, the liquid which stands in the lowermost tube will run out because the uppermost tube functions as en air valve. A second and more significant disadvantage is that the tubes must be long end curved in order to be able to function as intended. This means a relatively complicated construction which is expensive to produce. Moreover, if disposable suction tubes are not used, the suction tubes will be difficult to clean which will result in bacterial growth, which is unacceptable in connection with the use of the mug by small children.

SUMMARY OF THE INVENTION

The special feature of the invention is that the suction tube is substantially straight between its outlet and its inlet inside the mug, the inlet inside the mug being situated at a relatively short distance above the bottom, and that the mug is configured with substantially gastight joints, so that the flow of air to and from the interior of the mg is effected exclusively or almost exclusively through the suction tube. That the flow of air can take place almost exclusively through the suction tube is to be construed in the way that there can be leaks in the joints which, however, are so small that they have no influence on the properties of the mug according to the invention. For example, the leak of air to the interior of the mug is so small that it takes several minutes before this gives rise to the flow of liquid out through the suction tube when the mug is not standing in its normal upright position.

Since the suction tube is the only way in which the surrounding air can gain ingress to the inside of the mug, a partial vacuum will be created above the liquid in the mug when the liquid influenced by gravity seeks a way out through the suction tube, which happens for example when the mug is lying on its side or is turned upside down (the mouth of the suction tube is turned downwards). This underpressure will prevent the liquid from running out of the suction tube. Furthermore, the negative pressure which is formed above the surface of the liquid due to the suction of liquid when a person is drinking, will empty the suction tube of liquid. Because of the length of the suction tube, the liquid will be able to find its way some distance up through the suction tube, but without being able to flow out, whereby sufficient underpressure is formed above the surface of the liquid to prevent spillage.

If the mug is turned upside down so that the first mouth of the tube faces downwards, the tube's second mouth will as a rule be free of liquid. Compared to the known technique, the mug according to the invention can be built up in a simple manner with low costs of production, and use can be made of disposable suction tubes or re-usable suction tubes which are easy to clean.

Furthermore, because of the underpressure which is created during use of the mug, it is easier for the person drinking to control the amount which is sucked up. This is of special significance for small children, who when using known mugs or cups can get the milk (a non carbonated liquid) down the wrong way, which can result in coughing and spillage of milk.

In a preferred embodiment, a sealing ring is used to create a high degree of airtightness in the joint between the mug and the lid.

In a second embodiment of the invention, the mug is configured with a running fit in the form of relatively smooth surfaces which constitute mutually abutting parts in the joint between mug and lid. Such a joint can provide sufficient airtightness without any great frictional forces arising when the lid is turned or lifted from the mug.

To further prevent the spillage of liquid, the bottom of the mug can have at least one recess which, in the position of use, is located opposite the inlet to the suction tube, so that the inlet is down in the recess. When the bottom of the mug is turned upwards, a pocket is formed above the inlet of the suction tube, which is hereby protected against the ingress of liquid, especially if the mug is shaken. The liquid will then hit the bottom besides the recess, and possible risk of liquid spillage is further reduced since liquid will not gain ingress to the suction tube.

In a simple-to-produce configuration of the invention, the recess is annular and disposed symmetrically in the bottom. This embodiment will be preferred if, for example, a screw lid is used, where the suction tube can assume different positions above the bottom and along the side of the bottom.

It is moreover preferred that the lid can be secured on the mug by means of two or more bayonet locks, hereby enabling a secure connection to be achieved between the lid and the mug.

In order to ensure fixed positions of the lid in relation to the mug, while at the same time marking the position of the lid in the closed position, it is preferred that the bayonet locks are arranged with lateral pins which extend towards each other from the wall of the mug, and where in the lid there are cutouts which are configured in such a manner that by a mutual turning of the lid and mug they will cooperate with the pins so that the pins influence a flexible portion at the cutouts until the pins have passed a top point on the portions where the pins assume a locking position in relation to the cutouts, and from which locking position no further turning can be effected in the same direction, and where turning in the opposite direction can be effected only by overcoming a force which is caused by the passage of the top point by the pins in the opposite direction. When the lid and herewith the bayonet locks are turned towards the locking position for the pins, it will be possible to feel when the top point on the flexible portions has been past.

In a further embodiment of the mug according to the invention, the lid constitutes the bottom of the mug, and the cup is configured with a closed upper side except for the mouth of the suction tube which is located at or in the cup's upper side. With this construction, when the mug is to be filled the bottom is turned upwards, the lid is removed end the liquid is poured in. The inlet of the suction tube faces upwards during the filling. The mug can be filled up to the inlet which, at the connection to the mouth on the downwardly-turning upper side, constitutes the only outlet for the liquid. The advantage is that when the lid, i.e. in this case the bottom, is put on, the overpressure which will normally arise can be equalized through the suction tube without any spillage of liquid as the surface of the liquid lies below the mouth.

If the lid constitutes the bottom of the mug, it is also advantageous for the suction tube to be configured as a channel which extends mainly in a thickened part of the side of the cup. A simplified embodiment of the mug is hereby achieved, in that the suction tube is integrated in the wall of the mug, and the only disengageable joint required to be made airtight is the joint between the bottom and the cup.

BRIEF DESCRIPTION OF THE DRAWINGS

Embodiments of the invention will now be described in more detail with reference to the drawing, where.

DETAILED DESCRIPTION OF THE PREFERRED EMBODIMENTS

Figure 1:
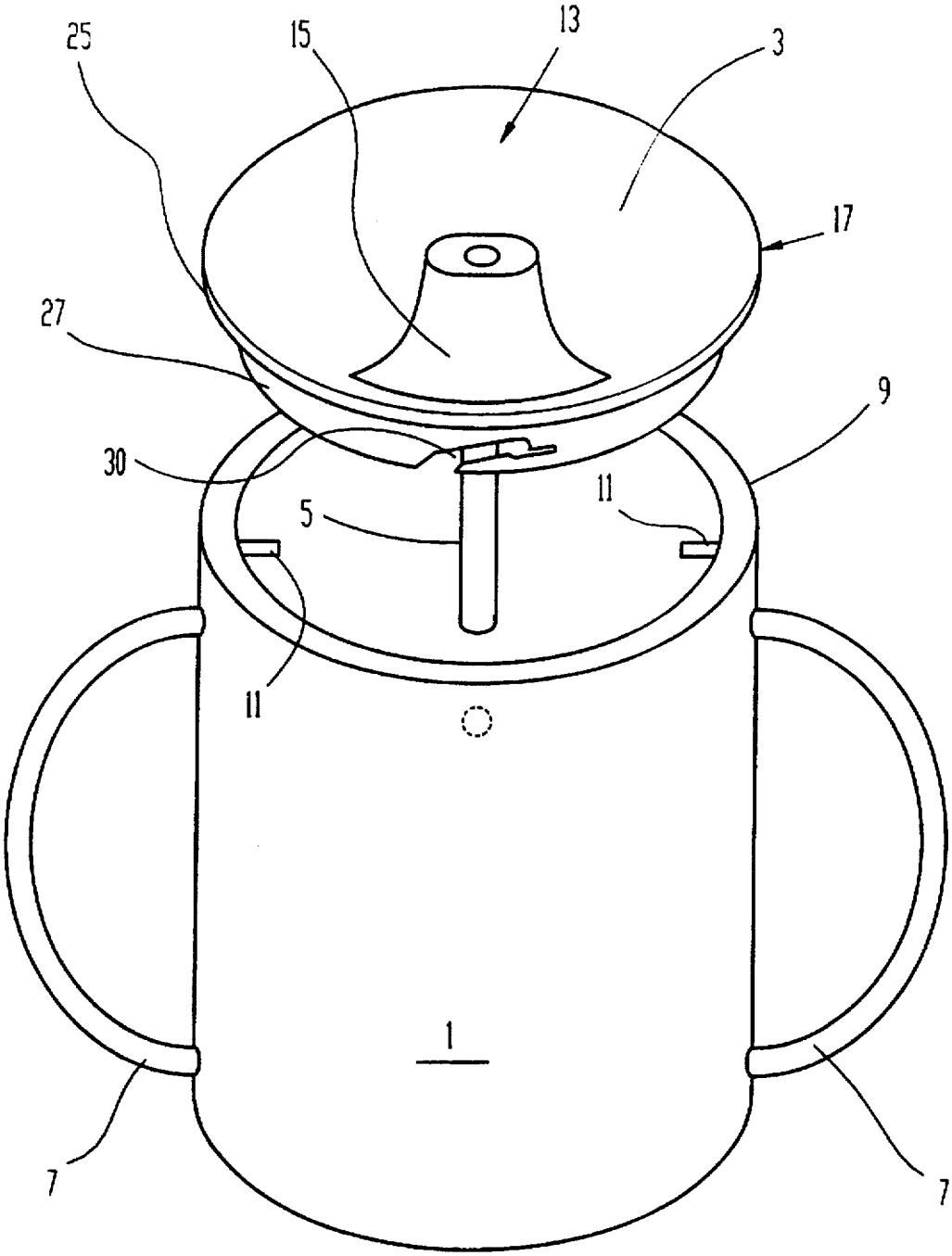
FIG. 1 shows a preferred embodiment of the drinking mug according to the invention seen in perspective from above and in partly dismantled condition.

A drinking mug for children, handicapped or hospital patients who ere unable to use open cups, glasses or mugs, comprises a cup 1, a lid 3 and a suction tube 5. It is preferred that the parts 1 and 3 are made of synthetic material, e.g. by injection moulding, while the suction tube 5 can be made of a synthetic material or a cellulose-containing material. In its preferred embodiment, the cup 1, which is described in the following, is provided externally with two mutually opposite handles 7. Along the edge 9 of the cup and at a short distance from the edge 9 there are four pins 11 which are arranged at mutually equal distances. It is preferred that the pins 11 ere cylindrical.

Figure 2A:
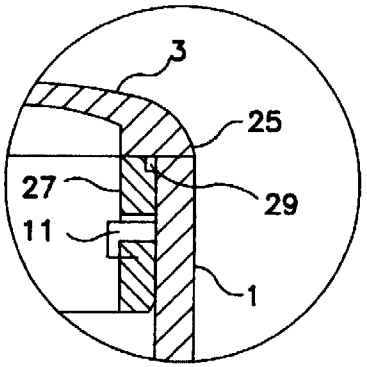
FIGS. 2*a* and 2*b* show two enlarged details in FIG. 2.
Figure 2B:
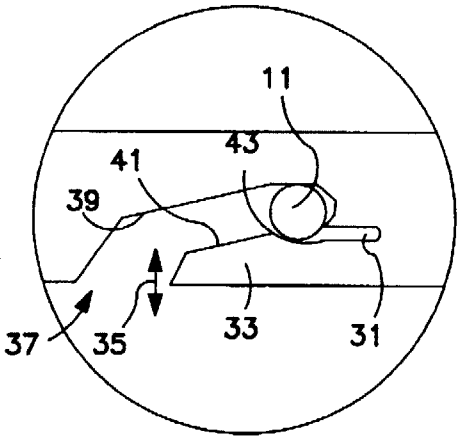
Figure 2:
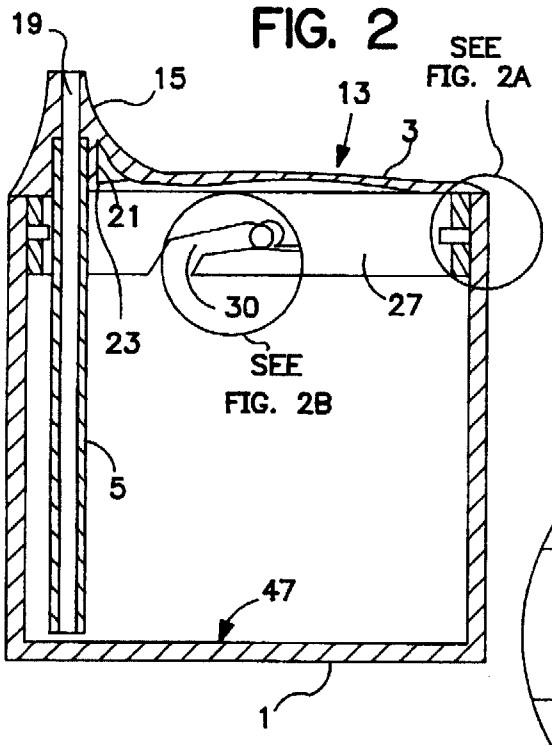
FIG. 2 shows a vertical section through the drinking mug in assembled condition.

The lid 3 is configured with an arcuate upper side 13 in which there is a assymmetrically-disposed mouthpiece in the form of a drinking spout 15 which extends upwards as a projection along edge 17. The spout 15 is provided with a single, through-going channel 19, although several channels can be envisaged. The channel 19 opens out on the inner side of the lid through a pipe stub, and here the suction tube 5 is secured. Use can be made of both disposable and permanent suction tubes 5, which are inserted in the spout 21. Permanent suction tubes 5, as shown in FIG. 2, can be removed for cleaning and have such a large wall thickness that a collar 23 or a shoulder can be provided which serves as an abutment against the end of the spout 21. When using disposable suction tubes, which can have thinner walls, the suction tube 5 can abut against a collar inside the spout 21.

The edge 17 is provided with a laterally-extending collar 25. An annular edge 27 extends down under the collar 25, and the edge has a groove in which there is mounted a sealing ring 29 in the form of an O-ring of rubber or another elastomer material. It is hereby ensured that the joint between the lid 3 and the cup 1 is airtight.

With other embodiments, the seal can be effected by hard or soft jointing material, and it is possible for the seal to be vulcanized, glued or welded firmly to the lid or the cup, and these arrangements can possibly be combined with the seal lying on an upwardly-facing or downwardly-facing flange in the cup or in the lid, all of which arrangements fall within the scope of the invention. Furthermore, the seal can lie loose or be configured as a belt on a cylindrical surface in the joint.

The edge 27 is provided with four cutouts which are indicated in general by the reference number 30, and which together with the pins 11 function as bayonet locks in the fastening of the lid 3 on the cup 1. At each cutout there is a narrow slot 31 which allows the adjacent, projecting portion 33 to exercise flexing movements in the directions as shown by the arrow 35. The cutouts 30 are configured in such a manner that the lid is first led downwards so that the pins 11 pass an opening 37 in the edge 27. Hereafter, the lid 3 must be turned, whereby the pins 11 force the lid downwards when the pins 11 slide along the parallel end slightly inclined section 39 and 41 in the edge 27 and the portion 33 respectively. The sealing ring 29 is thus forced into engagement with the inside of the cup. The lid 3 finds its locked position, as shown in FIG. 2*b*, when the pins 11 have passed a small upwardly-extending projection or top point 43, after which the portion 33, because of its flexible configuration, prevents any accidental movements away from the locked position. Upon passage of the top point 43, there is at the same time achieved a registration which can be felt during the manual turning of the lid 3. When the lid 3 is to be removed, it is necessary to overcome a resistance upon passage of the top point 43 and upon influence by the section 39 on the pins 11, the sealing ring 29 is pushed out of engagement with the inside of the cup. The bayonet locks ensure that the spout 15 assumes the same position in relation to %he cup every time, and at the same time it is ensured that the seal 29 is in airtight engagement.

With the preferred embodiment, four bayonet locks are employed, but another number of locks can be envisaged, in particular two locks whereby the the lid 3 can be secured only in two different positions in relation to the cup 1, which can be of significance for the position of the spout 15 in relation to the handles 7.

Figure 5:
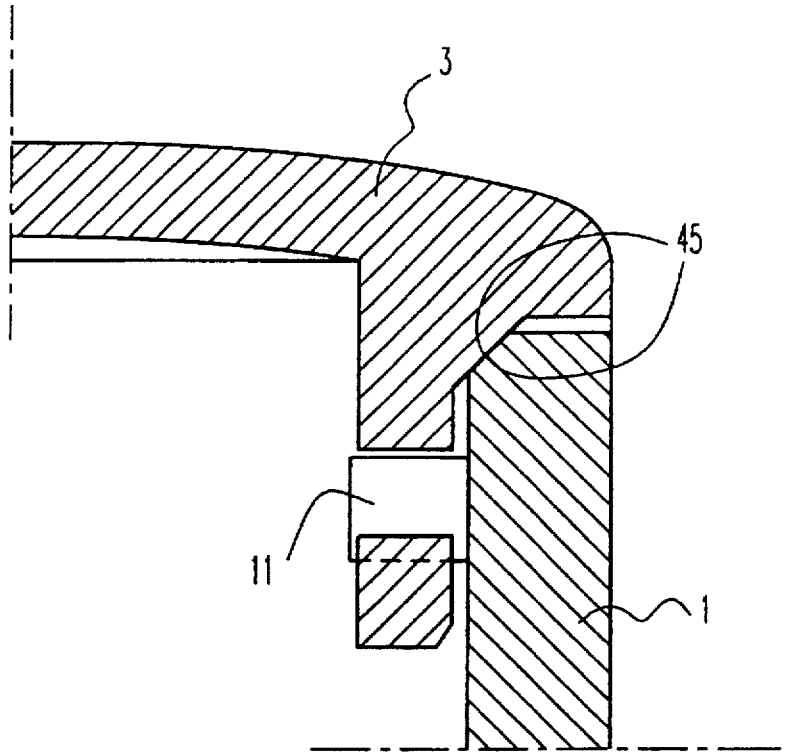
FIG. 5 shows a second embodiment of the joint between the lid and the mug.
Figure 6:
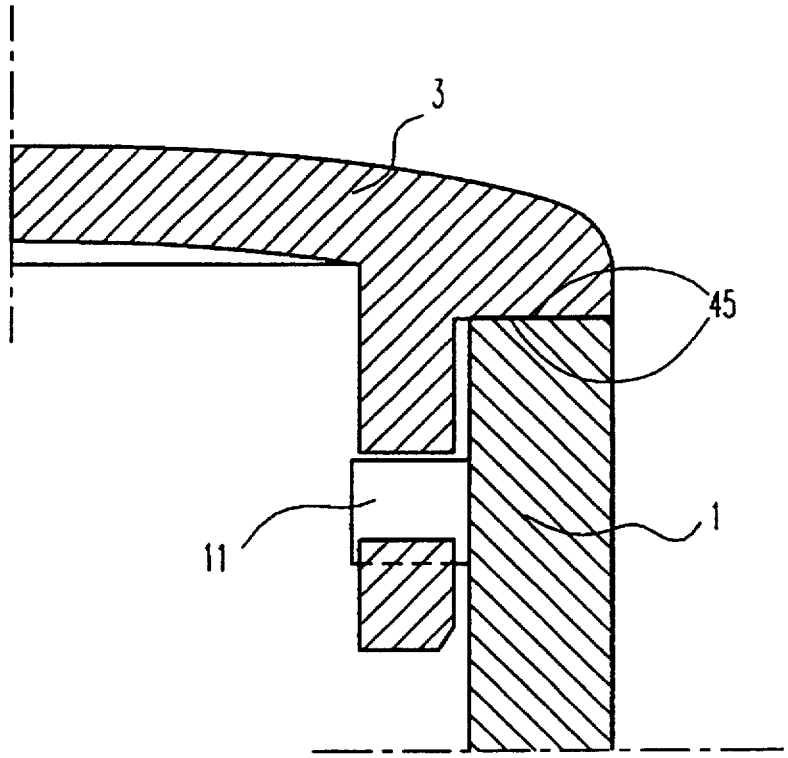
FIG. 6 shows a third embodiment of the joint between the lid and the mug.

Other configurations of the seal between the lid 3 and the cup 1 are possible. A second embodiment is seen in FIGS. 5 and 6, where mutually abutting, smooth surfaces 45 are provided on both the lid 3 and the cup 1. In FIG. 5 the surfaces 45 are conical, while in FIG. 6 they 45 are horizontal. A proper sealing in the joint can also be obtained by a suitable choice of material.

With the embodiments described above, use is shown of bayonet locks, but the drinking mug according to the invention can naturally also be configured with threaded connections or snap-locks between the lid end the cup, or the joint between the lid and the cup can simply be an interference fit.

In the preferred embodiment, the bottom 47 of the cup is lane, and as shown in FIG. 2 the suction tube 5 opens out at a relatively short distance over the bottom 47, so that the last remaining liquid can also be sucked up.

Figure 3:
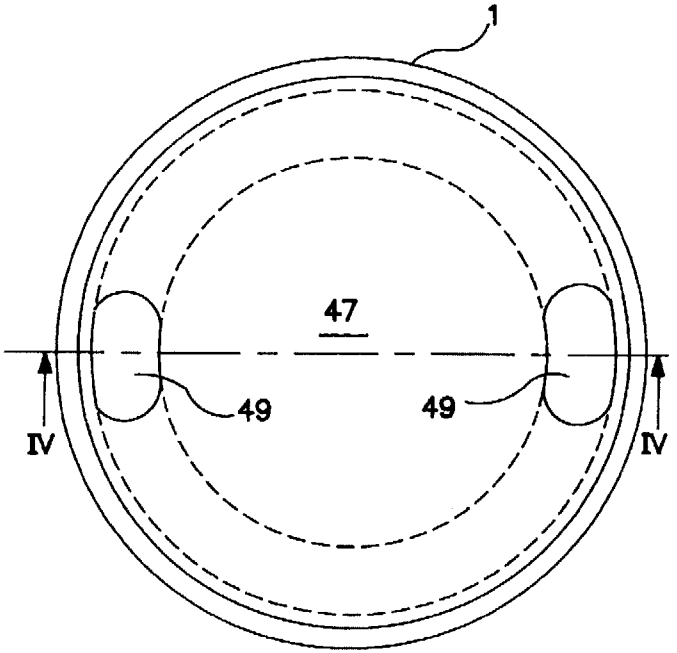
FIG. 3 shows a second embodiment for the bottom of the drinking mug seen from above.
Figure 4:
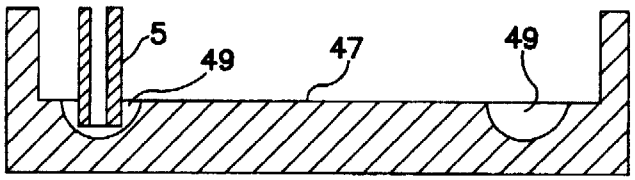
FIG. 4 shows a third embodiment for the bottom seen in section on the line IV—IV in FIG. 3.

In a second embodiment, the bottom is provided with one or two recesses 49, as shown in FIGS. 3 and 4. As indicated by the stippled line in FIG. 3, the recess can be annular so that the position of the suction tube is arbitrary. The suction tube 5 extends a short way down into the recess 49, which hereby creates a pocket where the liquid has difficulty in gaining ingress to the suction tube if the mug is turned upside down.

In other embodiments within the scope of the invention, the lid 3 or the cup 1, or the joint between lid 3 and cup 1 is provided with a not-shown, commonly-known air valve for the equalization of the overpressure on the drinking mug, drinking mug, which can arise particularly when the lid 3 is being put on the cup, and which will tend to press liquid out through the suction tube 5.

Moreover, the possibility exists of configuring the suction tube with a valve which opens for the through-flow of liquid when a person is sucking up liquid, but which closes when no suction is applied, and where the closing function is reinforced by the negative pressure created inside the mug. Drops of liquid in the suction tube are hereby prevented from running out when the bottom of the mug is turned upwards.

Furthermore, the joint between the suction tube 5 and the lid 3 can be configured in different ways. The lid 3 and the tube 5 can have threads, and the drinking spout can be configured in one piece with the suction tube, in that the drinking spout can then be removed from the lid for cleaning together with the suction tube. The lid, drinking spout and suction tube can be made in one piece, e.g. by the suction tube being welded or glued to the lid or the drinking spout. Moreover, the suction tube can be through-going in the lid, in that a seal is provided between the lid and the suction tube. The suction tube can have an angle in relation to the bottom 47, end the drinking spout and the suction tube's external opening can be disposed in the centre of the lid instead of near the edge 17, as described above.

Figure 7:
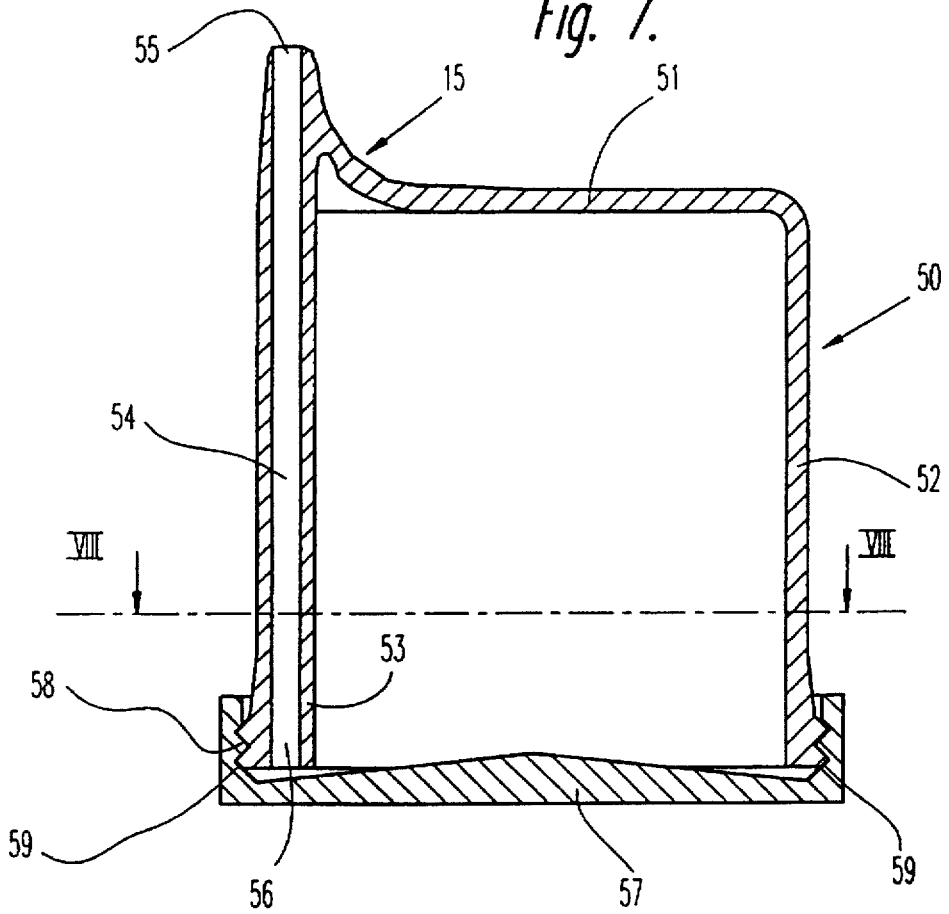
FIG. 7 shows a second embodiment of the drinking mug according to the invention, seen in section.
Figure 8:
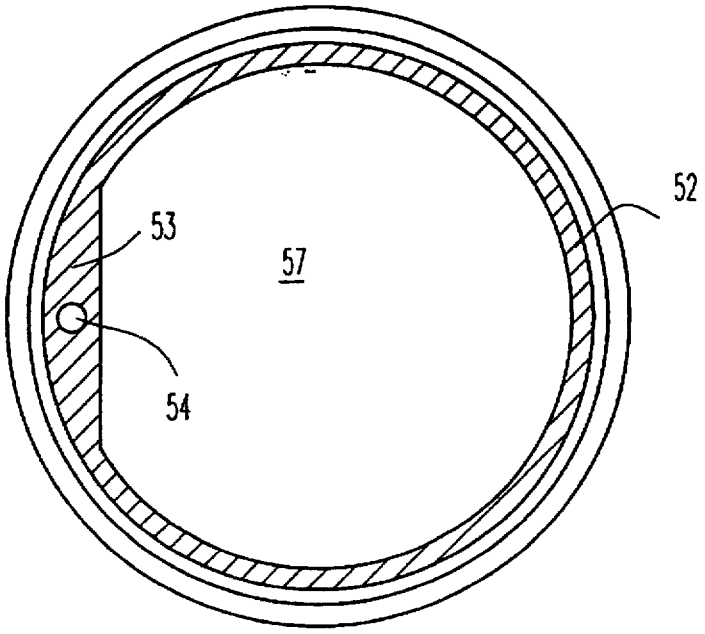
FIG. 8 shows a section on the line VIII—VIII in FIG. 7.

A second embodiment of the mug according to the invention is shown in FIGS. 7 and 8. The cup 50 is configured with an upper side 51 which is in one piece with the cylindrical side wall 52. At the wall 52 there is provided a thickening 53 which has a through-going channel 54. The channel 54 extends from its mouth 55 in the drinking spout 15 on the upper side 51 to an inlet 56 near the bottom 57, which as shown is slightly conical so that the liquid will run out towards the edge where the inlet 56 is found. The bottom 57 is configured as a screw lid with thread 58, and has a tight joint 59 which is effected by the mutually abutting surfaces having a fine fit. When the bottom 57, which functions as the lid, is taken off, the cup 50 with the upper side 51 facing downwards can be filled up to the inlet 56, and the bottom 57 is screwed on. The possible surplus air which stands over the surface of the liquid in the cup 50 will be able to escape through the channel 54 when the bottom 57 is being screwed on, and overpressure is hereby avoided. Hereafter, the mug can be turned over into its normal position shown in FIG. 7. Due to the airtight and liquid-tight joint 59, he same advantages are achieved as with the remaining embodiments described above. Since the suction tube is configured as intergrated channel 54, the configuration of the mug is simplified.

The embodiment shown in FIGS. 7 and 8 can be varied in different ways, particularly by combination with the embodiments previously described, e.g. by having a separate suction tube which can be disposable instead of a channel 54. Moreover, the channel 54 can be extended as a short stub in the vicinity of the bottom 57, e.g. so that the inlet 56 can extend down into a recess in the bottom 57.

I claim:

1. Drinking mug comprising a cup defining an opening for filling with liquid, a lid with means for removably connecting said lid to said cup to cover said opening in a gastight fashion, said lid having no air vent therethrough; and at least one continuous suction tube which extends from a mouth at a top side of the mug to an inlet end inside the mug disposed at a relatively short distance over a bottom of the mug, such that when a non-carbonated liquid is sucked from the interior of the mug through the suction tube, a partial vacuum will be created therein above the liquid to prevent further liquid spillage when the suction is discontinued, flow of air into the mug taking place exclusively through the suction tube.

2. Drinking mug according to claim 1, including a sealing ring between the lid and the mug.

3. Drinking mug according to claim 1, including mutually abutting sealing parts on said lid and said mug.

4. Drinking mug according to claim 1, wherein the bottom of the mug has at least one recess positioned in such a manner that the inlet to the suction tube is disposed opposite to and down in the recess.

5. Drinking mug according to claim 4, wherein the recess is annular and positioned symmetrically in the bottom.

6. Drinking mug according to claim 1, wherein said means for removably connecting said lid to said muq includes at least two bayonet locks.

7. Drinking mug according to claim 6, wherein the bayonet locks are configured with lateral pins which extend towards each other from a wall of the mug, and where cutouts are provided in the lid, said cutouts being configured to cooperate with the pins upon the mutual turning of lid and mug so that the pins actuate a flexible portion at the cutouts until the pins have passed a top point on the portions, where the pins assume a locking position in relation to the cutouts, where from said locking position no further movement can be made in the same direction; and wherein turning in the opposite direction can only be effected by overcoming a force which arises with the passage by the pins of the top point in the opposite direction.

8. Drinking mug according to claim 1, wherein the lid constitutes the bottom of the mug, and wherein the cup is configured with a closed top side with the exception of the mouth of the suction tube which is disposed at or in the top side of the cup.

9. Drinking mug according to claim 8, wherein the suction tube is configured as a channel which extends through a thicker part of the side of a cup.

10. Drinking mug according to claim 1, including a non-carbonated liquid in said cup.

* * * * *